United States Patent [19]

Groom et al.

[11] Patent Number: 4,947,026

[45] Date of Patent: Aug. 7, 1990

[54] TOWEL HEATING AND MOISTENING

[76] Inventors: Raymond C. Groom; Judy B. Groom, both of Rte. 2, Box 121, Picayune, Miss. 39466

[21] Appl. No.: 339,212

[22] Filed: Apr. 17, 1989

[51] Int. Cl.[5] ..... F22B 1/28

[52] U.S. Cl. ..... 219/401; 219/521; 219/214

[58] Field of Search ..... 219/401, 271, 272, 273, 219/275, 276, 385, 386, 521, 214, 403; 126/369, 369.1, 369.2, 369.3, 20, 20.1, 20.2

[56] References Cited

U.S. PATENT DOCUMENTS

| | | | |
|---|---|---|---|
| 1,344,326 | 6/1920 | Williams | 219/271 |
| 2,443,321 | 6/1948 | Miner | 219/401 |
| 2,719,211 | 9/1955 | Lewis | 219/401 |
| 2,863,979 | 12/1958 | Fitzgerald | 219/403 |
| 3,236,172 | 2/1966 | Haedike | 219/275 |
| 3,541,947 | 11/1970 | Anderson | 219/401 |
| 3,774,008 | 11/1973 | Maniscalco | 219/271 |
| 3,902,044 | 8/1975 | Doyle | 219/275 |
| 4,084,080 | 4/1978 | McMahan | 219/401 |
| 4,163,896 | 8/1979 | McAvinn et al. | 219/525 |
| 4,289,253 | 9/1981 | Anderson | 221/1 |
| 4,495,402 | 1/1985 | Burdick et al. | 219/214 |
| 4,700,048 | 10/1987 | Levy | 219/214 |

*Primary Examiner*—Teresa J. Walberg
*Attorney, Agent, or Firm*—Leon Gilden

[57] ABSTRACT

A towel heating and moistening apparatus sets forth a cabinet structure including an upper and lower reciprocatably mounted drawer. The upper drawer includes an enclosed support tray provided with a matrix of apertures therethrough for support of towels thereon. The lower drawer includes a lined reservoir heated by use of a heating loop provided with a thermostat, wherein the thermostat prevents overheating of the element upon dissipation of the fluid contained within the reservoir. A pump is provided and mounted to an exterior face of the cabinet to pump water from the reservoir through a flexible hose to a spray manifold to direct heated spray upon the towels positioned upon the support tray.

3 Claims, 1 Drawing Sheet

TOWEL HEATING AND MOISTENING

BACKGROUND OF THE INVENTION

1. Field of the Invention

The field of the invention relates to towel heating and moisturizing apparatus, and particularly pertains to a new and improved towel heating and moistening apparatus wherein the same directs heated water through an apertured support tray supporting a grouping of towels thereon and further provides for a spray manifold to direct heated water over the support tray supporting the towels.

2. Description of the Prior Art

The use of towel moistening apparatus is well known in the prior art. The prior art has included various devices to provide heated and moistened towels utilized in the application of such towels to various anatomical regions of individuals. Towels of this nature are typically utilized for therapeutic application of moistened heat to an individual as well as application within the shaving art to enable placing of such towels about the face of an individual. Examples of prior art devices may be found in U.S. Pat. No. 4,084,080, for example, to McMahan wherein a reservoir is provided with a heating element to direct heat to towels supported upon a tray overlaying the reservoir. The McMahan patent fails to provide the overhead spray of the instant invention, as well as the reciprocatably mounted reservoir within a cabinet-like structure, as utilized by the instant invention.

U.S. Pat. No. 4,163,896 to McAvinn sets forth a towel moisturizing apparatus wherein a suitcase-like device is provided with a heating element and a sponge-like member of direct heat to towels and is of interest relative to the heating of towels, but is of a relatively remote organization to that of the instant invention.

U.S. Pat. No. 4,289,253 to Andersson sets forth a warming and dampening apparatus wherein a plastic-coated box is folded into a trough and wherein a quantity of water is heated and is poured into the trough and over associated napkins or towels positioned within the trough.

U.S. Pat. No. 4,495,402 to Burdick sets forth a warming and heating apparatus for moisturizing towels and other articles wherein a heating element underlies a reservoir to direct heat upwardly to the towels including a thermo-sensor and associated circuitry for controlling the temperature of the water to be heated.

U.S. Pat. No. 4,700,048 to Levy sets forth a towelette dispenser including underlying atttachment which enables heating of the moisturized towels contained within the dispenser.

As such, it may be appreciated that there is a continuing need for a new and improved towel heating and moistening apparatus as set forth by the instant invention which addresses both the problems of ease of use and effectiveness in construction, and in this respect, the present invention substantially fulfills this need.

SUMMARY OF THE INVENTION

In view of the foregoing disadvantages inherent in the known types of towel heating and moistening apparatus now present in the prior art, the present invention provides a towel heating and moistening apparatus wherein the same provides for reciprocatably mounted drawers to enable storage and access to towels and an underlying reservoir to be heated to enable the reservoir and the towel support compartments to be readily replenished and enable use of access thereto. As such, the general purpose of the present invention, which will be described subsequently in greater detail, is to provide a new and improved towel heating and moistening apparatus which has all the advantages of the prior art towel heating and moistening apparatus and none of the disadvantages.

To attain this, the present invention comprises a towel heating and moistening apparatus formed within a cabinet-like structure provided with an upper reciprocatably mounted drawer overlying a lower reciprocatably mounted drawer. The upper drawer is formed with a central through-extending cavity provided with a support tray extending across the cavity wherein the support tray is provided with a matrix of apertures to enable steam created within the lower drawer to be directed through the apertures onto towels supported upon the support tray. The lower drawer is provided with a stainless steel or polymeric lining to contain a reservoir of water therein. A heating element is directed interiorly of the drawer and into the reservoir to heat the water contained therein and is provided with a thermostatic control to maintain a predetermined temperature of the heating element and prevent overheating of the element upon the pollution of the water within the drawer. A fluid pump is secured to an exterior face of the cabinet and includes a flexible hose provided with an intake directed into the reservoir to receive water therein and to direct such water to a spray manifold overlying the support tray to direct heated water periodically to the towels upon the support tray. The heating element is provided with rearwardly extending legs of the drawer that are received within a socket that is fixedly secured rearwardly of the drawer to effect a disconnection of the heating element upon removal of the drawer.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved towel heating and moistening apparatus which has all the advantages of the prior art towel heating and moistening apparatus and none of the disadvantages.

It is another object of the present invention to provide a new and improved towel heating and moistening apparatus which may be easily and efficiently manufactured and marketed.

It is a further object of the present invention to provide a new and improved towel heating and moistening apparatus which is of a durable and reliable construction.

An even further object of the present invention is to provide a new and improved towel heating and moistening apparatus which is susceptible of a low cost of manufacture with regard to both materials and labor, and which accordingly is then susceptible of low prices of sale to the consuming public, thereby making such towel heating and moistening apparatus economically available to the buying public.

Still yet another object of the present invention is to provide a new and improved towel heating and moistening apparatus which provides in the apparatuses and methods of the prior art some of the advantages thereof, while simultaneously overcoming some of the disadvantages normally associated therewith.

Still another object of the present invention is to provide a new and improved towel heating and moistening apparatus wherein the same provides for an automatic disconnection of the heating element upon visual inspection of the reservoir of the apparatus.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 5:
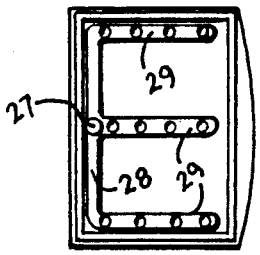
FIG. 5 is an orthographic view taken along the lines 5—5 of FIG. 2 in the direction indicated by the arrows.
Figure 6:
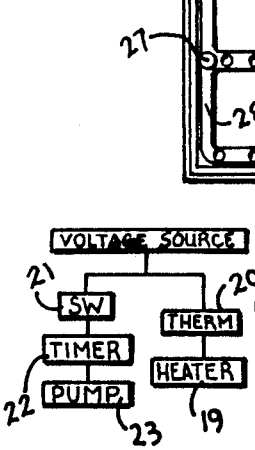
FIG. 6 is a diagrammatic illustration of the control mechanism of the instant invention.

With reference now to the drawings, and in particular to FIGS. 1 to 6 thereof, a new and improved towel heating and moistening apparatus embodying the principles and concepts of the present invention and generally designated by the reference numeral 10 will be described.

More specifically, it will be noted that the towel heating and moistening apparatus 10 essentially comprises a cabinet structure 13 provided with an upper surfaced, a forward surface orthogonally oriented relative to the upper surface with a parallel rear face 13*a*, and side walls to provide an enclosed cabinet structure housing an upper slidably retractable first drawer 14 overlying a lower slidingly retractable second drawer 15. The first drawer 14 is formed with a through-extending open cavity securing a support tray 16 orthogonally relative to the walls of the upper drawer wherein the support tray 16 is provided with a series of through-extending apertures 17. The lower second drawer 15 is provided with a moisture impermeable layer 18 formed of stainless steel or polymeric materials to provide a reservoir for containment of water therein. The reservoir formed with the second drawer 15 includes an elongate heating loop 19 extending into the reservoir within the water "W" to heat the water and effect steam generation that is directed upwardly through the apertures 17 and onto the towels 11 supported upon the support tray 16. The towels 11 are typically formed of fibrous material that is either of cloth or celluloid derivative and may further be impregnated with a scented material to effect an aromatic scenting of the environment about the apparatus 10.

Figure 1:
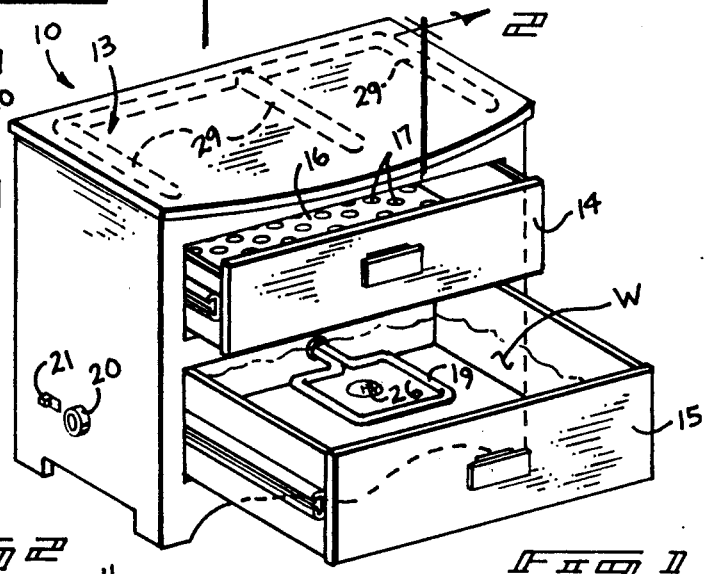
FIG. 1 is an isometric illustration of the instant invention.
Figure 2:
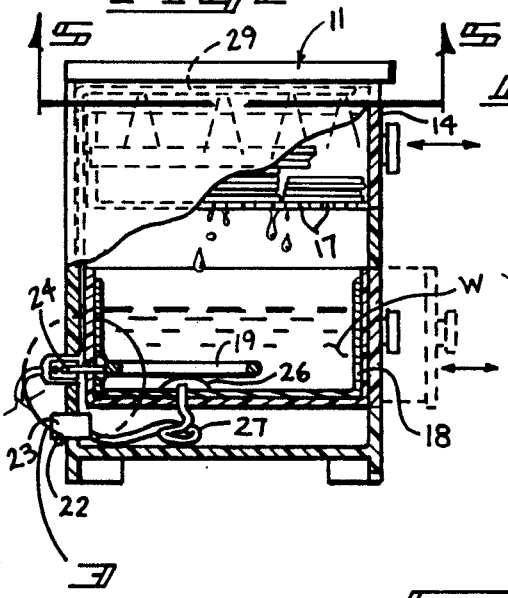
FIG. 2 is an orthographic view taken along the section line 2 of FIG. 1 in the direction indicated by the arrow.
Figure 3:
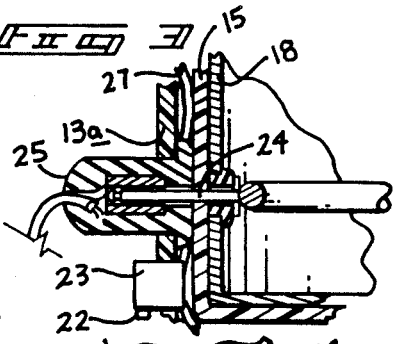
FIG. 3 is an orthographic view, somewhat expanded, of the portion 3 indicated in FIG. 2.
Figure 4:
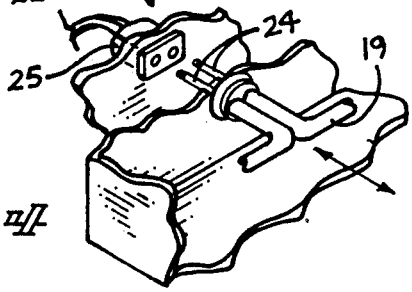
FIG. 4 is an isometric illustration of the heating element and its association with the socket.

The heating loop 19 is controlled by a thermostat 20 formed to an exterior side wall of the cabinet structure 13 wherein the thermostat 20 enables the heating element to be shut off in the event of the dissipation of the water within the second drawer 15 to minimize destruction of the heating loop 19. The heating loop 19 includes a plurality of spaced connector legs 24 extending rearwardly and exteriorly of the second drawer 15 and orthogonally relative to the rear wall of the second drawer 15 to be received within bores of a socket 25 fixedly secured to the rear wall 13*a* of the cabinet structure 13. The socket bores formed within the socket 25 electrically communicate the heating loop 19 with an electrical source to enable immediate disconnection of the heating loop from the electrical source when the lower drawer 15 is withdrawn from the cabinet structure 13, as illustrated in FIGS. 1 and 4 for example, to minimize accidental injury to an individual replenishing the reservoir within the second drawer 15. A screen pickup 26 extends through the floor of the second drawer 15 and is provided with a screen surface to filter debris from entering a flexible hose 27 secured and in communication with the screen pickup 26. The flexible hose 27 is secured to a pump 23 that directs the water upwardly through the flexible hose 27 rearwardly through the first and second drawers 14 and 15 respectively to a spray manifold 28 provided with forwardly extending apertured legs 29 to direct heated water downwardly upon the towels 11. A switch 21 enables the pump 23 to be energized, and a timer 22 enables periodic actuation of the pump for periodic directing of heated water to the towels 11. It is understood that the flexible hose 27 is of a length and coiled underlying the floor of the second drawer 15 to enable complete withdrawal of the second drawer 15 from the cabinet 13, as illustrated in FIG. 1 for example.

It should be noted that the second drawer 15 is of a length greater than that of the first drawer 14 to ensure that water directed through the apertures 17 are received within the reservoir of the second drawer 15.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A towel heating and moistening apparatus for heating and moistening towels wherein said apparatus comprises a cabinet structure including an upper first compartment member overlying a second compartment member, said first compartment member including a central through-extending cavity securing a tray therein, said tray including a matrix of apertures for support of said towels on said tray, said second compartment including a water reservoir with a heating member extending into said reservoir to enable water contained within said reservoir to be heated into steam and directed through said matrix of apertures to heat and moisten said towels, and wherein said first compartment member and said second compartment member are slidingly and reciprocatably mounted within said cabinet structure, and wherein said second compartment member includes a heating member extending into said reservoir, and said heating member controlled by a thermostatic member, and wherein said second compartment member includes a lining of impermeable stainless steel material, and wherein said heating member further includes a plurality of legs extending rearwardly of said second compartment member and slidably receivable within a socket, said socket fixedly secured to a rear wall of said cabinet structure and wherein said socket enables selective communication of said legs with an electrical energy source, and further including a fluid pickup member extending through a floor of said second compartment member and said pickup secured to a flexible hose, said flexible hose directed rearwardly of said first and second compartment members between said first and second compartment members and the rear face of the cabinet structure and in fluid communication with a spray manifold.

2. A towel heating and moistening apparatus as set forth in claim 1 wherein said spray manifold includes a plurality of apertured legs overlying the support tray.

3. A towel heating and moistening apparatus as set forth in claim 2 wherein the second compartment member is of a length greater than the first compartment member to receive condensed steam from the support tray 16.

* * * * *